United States Patent [19]

Marsh et al.

[11] 3,943,744

[45] Mar. 16, 1976

[54] LOUVER CUTTER

[75] Inventors: Walter G. Marsh, Birmingham; James J. Rhoades, Westland, both of Mich.

[73] Assignee: Tapco Products Company, Inc., Detroit, Mich.

[22] Filed: June 19, 1974

[21] Appl. No.: 480,813

[52] U.S. Cl. ..... 72/326; 72/446; 72/472; 83/552

[51] Int. Cl.[2] ..... B21D 31/02

[58] Field of Search ..... 72/326, 332, 325, 386, 72/445, 481, 446, 472; 83/552; 269/60

[56] References Cited

UNITED STATES PATENTS

| | | | |
|---|---|---|---|
| 562,368 | 6/1896 | Barry | 72/445 |
| 852,443 | 5/1907 | Marbach | 83/552 |
| 1,544,393 | 6/1925 | Hatcher et al. | 83/552 |
| 1,704,962 | 3/1929 | Bollaert | 83/552 |
| 1,926,985 | 9/1933 | Podrabsky | 83/552 |
| 2,748,864 | 6/1956 | Ewaldson et al. | 83/552 |
| 3,052,279 | 9/1962 | Collin et al. | 72/481 |
| 3,717,022 | 2/1973 | DuBois | 72/386 |

*Primary Examiner*—C. W. Lanham
*Assistant Examiner*—James R. Duzan
*Attorney, Agent, or Firm*—Barnes, Kisselle, Raisch & Choate

[57] ABSTRACT

A louver cutter comprising a body having a pair of spaced arms, the lower arm defining a base and the upper arm overlying the base. A lower die pad is rotatably mounted on the base for rotation about a vertical axis and is lockable in any adjusted position. A lower die block is fastened to the lower die pad such that the lower die pad has a portion projecting upwardly and spaced from the lower die block. A piston is slidable for vertical movement in said upper arm and means are provided for moving the piston toward and away from the lower die block. An upper die block is mounted on the piston and has an opening into which the piston extends. A fastener holds the upper die block on the piston. The upper die block has a vertical surface and a horizontal surface engaging the vertical and horizontal surfaces of a cutter blade. A resilient pad on the underside of said upper die block is adapted to engage the upwardly extending portion of said lower die pad during the final movement of the blade downwardly adjacent in cooperative relation with the lower die block.

4 Claims, 8 Drawing Figures

LOUVER CUTTER

This invention relates to louver cutters.

BACKGROUND OF THE INVENTION

It has heretofore been suggested that louvers can be formed in aluminum sheet or siding material by moving a cutting blade into engagement with a die in a portable device. Such a device is shown, for example, in U.S. Pat. No. 3,717,022, issued Feb. 20, 1973.

Among the objects of the present invention are to provide an improved louver forming device which will effectively hold the cutting blade; wherein the cutting blade may be readily removed and replaced; wherein the cost of the device is substantially reduced; and which will produce louver openings in diverse pieces of material.

SUMMARY OF THE INVENTION

The louver cutter embodying the invention comprises a body having a pair of spaced arms, the lower arm defining a base and the upper arm overlying the base. A lower die pad is rotatably mounted on said base for rotation about a vertical axis, and is lockable in any adjusted position. A lower die block is fastened to the lower die pad such that the lower die pad has a portion projecting upwardly and spaced from the lower die block. A piston is slidable for vertical movement in the upper arm and means are provided for moving the piston toward and away from the lower die block. An upper die block is mounted on the piston and has an opening into which the piston extends. A fastener holds the upper die block on the piston. The cutter blade comprises planar contacting surfaces and a base surface. The upper die block has a vertical surface and a horizontal surface engaging the vertical and horizontal surfaces of the blade. The opening in the upper die block extends through to expose a portion of the piston and the piston has vertical and horizontal surfaces complementary to the vertical and horizontal surfaces of the die block for engaging portions of the vertical and horizontal surfaces of the blade to align the blade and hold it firmly.

DESCRIPTION

Figure 1:
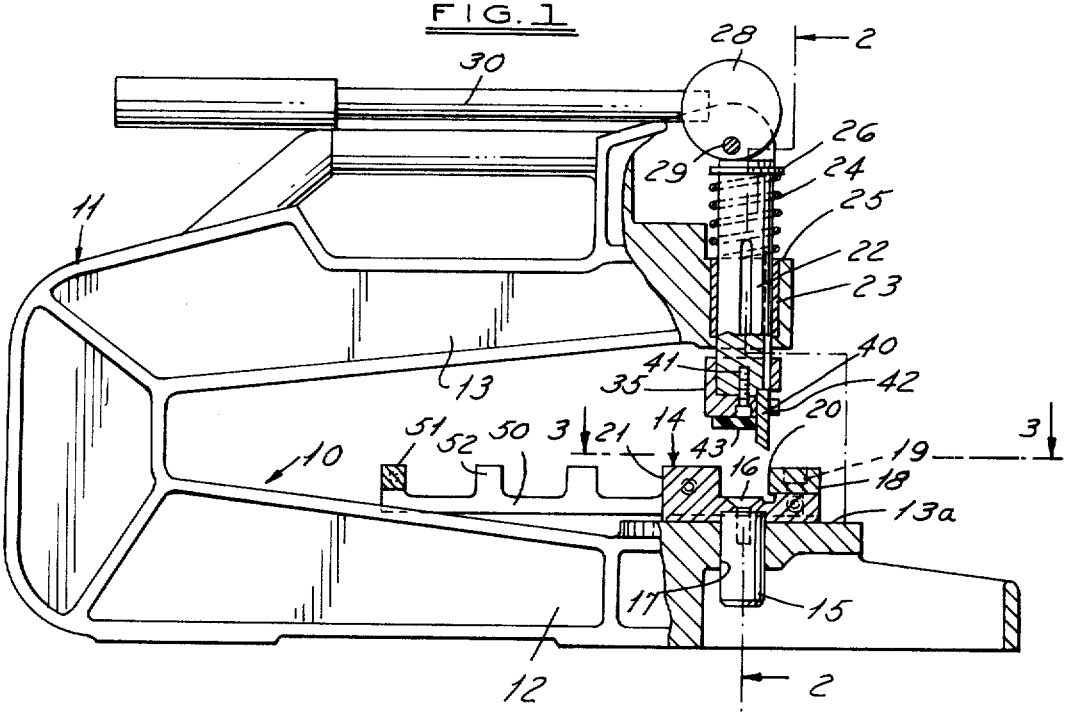
FIG. 1 is a part sectional side elevational view of a device embodying the invention.
Figure 2:
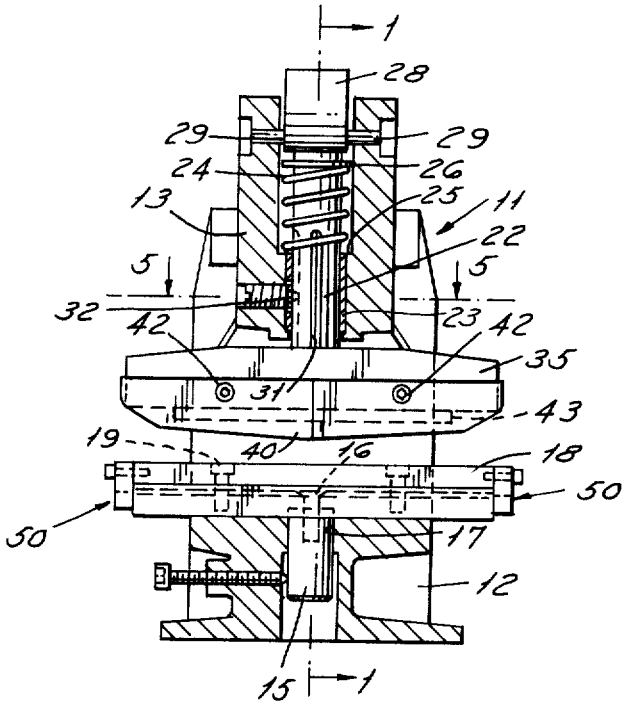
FIG. 2 is a sectional view taken along the line 2—2 in FIG. 1.
Figure 3:
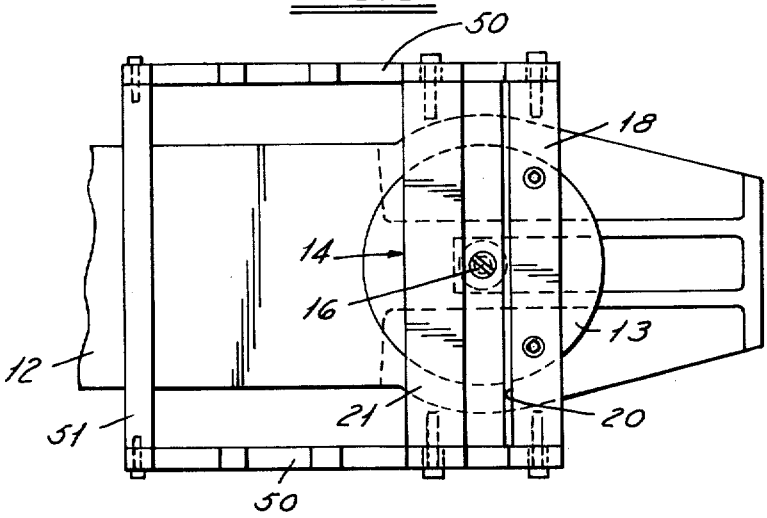
FIG. 3 is a fragmentary view taken along the line 3—3 in FIG. 2.
Figure 4:
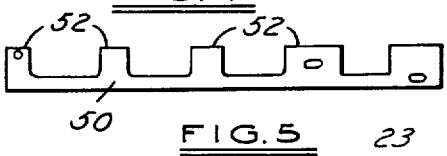
FIG. 4 is a side elevational view of a part of the device.
Figure 5:
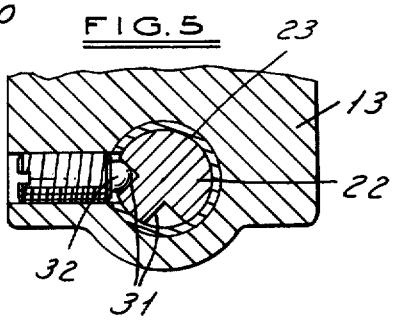
FIG. 5 is a fragmentary sectional view taken along the line 5—5 in FIG. 2.

Referring to FIG. 1, the louver forming device 10 embodying the invention comprises a body 11 which is preferably formed by a casting and has a C-shaped configuration. The body 11 includes a lower arm 12 and an overlying upper arm 13. The lower arm 12 forms a base whereby the device can be rested on a work surface and has a flat upper surface 13*a* on which a lower die pad 14 is rotatably mounted. Lower die pad 14 is generally L-shaped and includes a flat undersurface engaging the surface 13*a*. The die pad 14 is preferably formed as an extrusion and a pivot pin 15 is fastened thereto by a screw 16 and extends through an opening 17 in lower arm 12 to rotatably mount the pad on the lower arm 12. A steel die block 18 is fixed by screws 19 to the forward portion of the lower die pad 14 to define an edge 20 that cooperates with a cutting blade, as presently described. The openings into which screws 19 extend may be larger than the screws to permit some adjustment of the die block 18 with respect to the die pad 14.

The rear portion 21 of the lower die pad is spaced from the lower die block 18 and extends upwardly the same distance to provide a support for the workpiece or sheet of material which is to be formed with louver openings. The upper surface of the rear portion 21 also serves as an anvil for clamping the sheet, as presently described.

Figure 6:
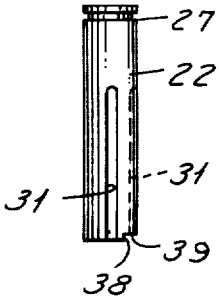
FIG. 6 is a side elevational view of another part.
Figure 7:
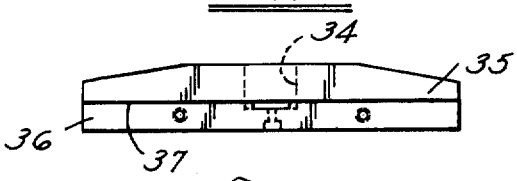
FIG. 7 is a front elevational view of another part.

The upper arm 13 has a piston 22 slidably mounted in a vertical opening 23 therein. The piston is urged upwardly by a spring 24 interposed between a shoulder 25 and a snap ring 26 that extends into a groove 27 (FIG. 6). The piston, being yieldingly urged upwardly, engages an eccentric 28 that is pivoted to the upper arm 13 by an axle 29. A handle 30 is provided for rotating the eccentric 28. By oscillating the eccentric 28, the piston 22 is moved upwardly and downwardly.

In order that the piston and, in turn, the cutting blade that is mounted thereon may be indexed angularly to accommodate various configurations of sheets of material, grooves 31 are provided in angularly spaced relation on the periphery thereof and extend axially of the piston. A spring-loaded plunger 32 engages selectively the grooves in the piston 22 to hold the piston in any angularly adjusted position.

The lower end of the piston extends into an opening 34 in an upper die block 35. The upper die block 35 includes vertical and horizontal surfaces 36, 37 which are engaged by complementary vertical and horizontal surfaces on a knife or cutter blade 40. The opening 34 extends downwardly below the surface 37 and the piston is also provided with surfaces 38, 39 that are complementary and coplanar, respectively, with surfaces 36, 37 to define a seat for the blade. The blade thus engages both the upper die block and the piston 22. A screw 41 is threaded into the lower end of the piston 22 to hold the upper die block 35 on the piston 22. Screws 42 hold the blade in position on the upper die block 35 and piston 22. In order to replace the blade, the screws are merely loosened and the blade is removed and replaced without affecting the relationship between the upper die block 35 and the piston.

A resilient pad 43 of rubber or the like is provided on the undersurface of the upper die block 35 in spaced relation to the cutting edge of the blade 40.

Figure 8:
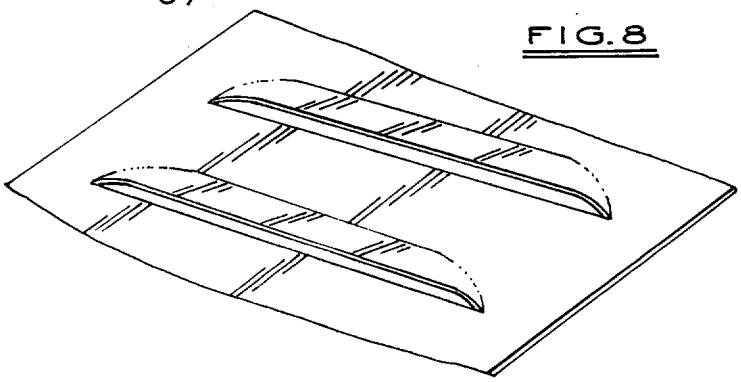
FIG. 8 is a fragmentary view of a louver formed by the apparatus embodying the invention.

Upon operation of the handle, the eccentric cam 28 forces the piston downwardly moving the blade 40 toward the edge 20 to slit a sheet of material placed in position. Continued downward movement of the piston causes the pad 43 to clamp the sheet material against the upper surface of the portion 21 of the lower die pad 14 so that continued movement of the blade will deform the metal into a manner of a louver opening which has curved end portions as shown in FIG. 8. Although a rubber pad is preferred, satisfactory results can be achieved if a portion of the upper die block extends downwardly to clamp the sheet and also deform the portion between the clamped portion and slit portion downwardly to form the louver.

In order to assist in accurate forming of successive openings, a guide device can be provided and comprises guide rails 50 which are fastened to the lower die pad and connected at their ends by a cross bar 51. The guide rails include upwardly extending projections 52. As one louver opening is completed, the sheet is indexed bringing the nailing edge or lip of the sheet into register with successive spaces between the projections 52 thereby assisting in proper alignment.

It can thus be seen that since the blade is mounted in complementary relationship to both the piston and the upper die block, it is held firmly and yet can be readily replaced with minimum dis-assembly. Although both vertical surfaces 36, 38 and horizontal surfaces 37, 39 are preferred, satisfactory results can be achieved by providing only coplanar surfaces 36, 38 on the upper die block against which the blade 40 is clamped. The latter construction permits vertical alignment of the blade where tolerances are not maintained.

Since the upper die blcok and lower die pad are made of aluminum extrusions, they can be economically produced from continuous lengths of material.

We claim:

1. A louver cutter comprising
a body having a pair of spaced arms,
the lower arm defining a base and the upper arm overlying the base,
a lower die pad,
means for rotatably mounting said lower die pad on said base for rotation about a vertical axis,
means for locking said lower die pad in any adjusted position,
a lower die block,
means for fastening said lower die block on said lower die pad such that the lower die pad has a portion projecting upwardly and spaced from the lower die block,
a cylindrical piston slidable for vertical movement in said upper arm and selectively indexable in said upper arm,
means for moving said piston toward and away from said lower die block,
an upper die block,
said upper die block comprising an opening therein into which said piston extends,
said opening having a substantially closed bottom,
the end of said piston abutting the bottom of said opening,
and fastener means for releasably holding said upper die block on said piston,
a cutter blade,
said cutter blade having a contacting surface,
said upper die block having a complementary surface engaging said surface of said blade,
said upper die blcok having a portion thereof cut away to define an opening to expose a portion of said piston,
said piston having a surface complementary and aligned with the related surface of said die block is engaged by said surface of said blade through said opening in said upper die block,
and fastener means for releasably holding said blade on said upper die block and, in turn, holding said die block against rotation with respect to said piston.

2. The combination set forth in claim 1 including a pad on the underside of the closed end of said upper die block and adapted to engage the upwardly extending portion of said lower die pad during the final movement of the knife downwardly in cooperative relation with the lower die block.

3. A louver cutter comprising
a body having a pair of spaced arms,
the lower arm defining a base and the upper arm overlying the base,
a lower die pad,
means for rotatably mounting said lower die pad on said base for rotation about a vertical axis,
means for locking said lower die pad in any adjusted position,
a lower die block,
means for fastening said lower die block on said lower die pad such that the lower die pad has a portion projecting upwardly and spaced from the lower die block,
a cylindrical piston slidable for vertical movement in said upper arm and selectively indexable in said upper arm,
means for moving said piston toward and away from said lower die block,
an upper die block,
said upper die block on said piston comprising an opening therein into which said piston extends,
said opening having a substantially closed bottom,
the end of said piston abutting the bottom of said opening,
and fastener means for holding said lower die block on said piston,
a cutter blade,
said cutter blade having planar angularly related contacting surfaces at a right angle to one another,
said upper die block having angularly related surfaces engaging said surfaces of said blade,
said upper die block having a portion thereof cut away to define an opening to expose a portion of said piston,
said piston having angularly related surfaces complementary and coplanar to the angularly related surfaces of said die block engaging said angularly related surfaces of said blade through said opening in said upper die block,
and fastener means for releasably holding said blade on said upper die block and, in turn, holding said die block against rotation with respect to said piston.

4. The combination set forth in claim 3 including a resilient pad on the underside of said upper die block and adapted to engage the upwardly extending portion of said lower die pad during the final movement of the knife downwardly in cooperative relation with the lower die block.

* * * * *